United States Patent [19]

McClelland et al.

[11] Patent Number: 4,504,957

[45] Date of Patent: Mar. 12, 1985

[54] HIGH TEMPERATURE BOX ANNEALING FURNACE

[75] Inventors: John R. McClelland, Butler, Pa.; Wade S. Wright, Fairfield, Ohio; Edward P. Diamond, Nashport, Ohio; Leroy C. Pryor, Chandlersville, Ohio; Douglas R. Olson, Ashland, Ky.

[73] Assignee: Armco Inc., Middletown, Ohio

[21] Appl. No.: 435,338

[22] Filed: Oct. 20, 1982

[51] Int. Cl.[3] ..... F27B 9/00

[52] U.S. Cl. ..... 373/130; 266/263; 373/119; 373/137; 432/254.2

[58] Field of Search ..... 373/119, 130, 137, 135, 373/136; 432/254.1, 254.2, 260; 266/262, 263, 266/264

[56] References Cited

U.S. PATENT DOCUMENTS

| | | | |
|---|---|---|---|
| 2,084,241 | 6/1937 | Capper | 266/263 |
| 4,088,825 | 5/1978 | Carr | 373/130 |
| 4,147,506 | 4/1979 | Southern et al. | 266/262 X |
| 4,154,975 | 5/1979 | Sauder | 373/130 |

*Primary Examiner*—A. D. Pellinen

*Assistant Examiner*—Gregory D. Thompson

*Attorney, Agent, or Firm*—Frost & Jacobs

[57] ABSTRACT

A high temperature box annealing furnace for metallic coil annealing practices. The furnace comprises a fixed base and a removable bell capable of achieving a sealed relationship with the base. The interior of the bell side walls, end walls and roof are lined with ceramic fiber insulation and are provided with electrical resistance heating elements. The heating elements are divided into at least two separately controllable zones, a first zone including the heating elements mounted on the bell roof and the upper portions of the bell side and end walls and a second zone including the heating elements mounted on the lower portion of the bell side and end walls. The base comprises a steel framework supporting a cast refractory base member configured to support one or more coils. Each coil is provided with a cover and the cast refractory base member provides a sand seal for the lower edge of the covers. The cast refractory base has an atmosphere inlet for each coil positioned at the center or eye of the coil. Cooling capacity for the furnace is provided by inlets and outlets for an appropriate cooling gas.

19 Claims, 4 Drawing Figures

HIGH TEMPERATURE BOX ANNEALING FURNACE

TECHNICAL FIELD

The invention relates to a high temperature box annealing furnace and more particularly to such a furnace providing an optimum combination of product quality (magnetic and physical), furnace productivity, low maintenance, and energy savings.

BACKGROUND ART

The furnace of the present invention can be used in any metallic coil annealing practice. Exemplary of such practices are those used in the manufacture of punching quality oriented silicon steel, regular grain oriented silicon steel and high permeability oriented silicon steel. Such silicon steels, for example, are given a high temperature final anneal at a minimum coil temperature requirement of 2150° F. at soak. These temperatures are achieved in an atmosphere of pure hydrogen or a combination of hydrogen and nitrogen. It is during such an anneal that the final magnetic qualities of the silicon steel are achieved and that a mill glass (if desired) is formed on the silicon steel.

Prior art workers have devised numerous types of high temperature box annealing furnaces. Generally, such furnaces comprise a base and a removable bell. These furnaces are normally lined with refractory bricks which are tied together. Such bricks usually require periodic maintenance and replacement, at least one wall at a time. Furthermore, the refractory brick lining absorbs significant amounts of heat, lengthening the heat-up portion of the furnace cycle. Refractory bricks are also characterized by high heat retention properties which tend to prolong the cool-down portion of the furnace cycle.

Location of the heating elements of such furnaces is a matter of major concern since the manner in which the coils are heated has a direct impact on the combination of resultant physical and magnetic qualities of the product, as well as furnace productivity. Tightly wound coils of silicon steel provided with an annealing separator in the form of a magnesia coating or the like demonstrate a large difference between radial and axial heat conductivities. In general, these coils are characterized by greater heat conductivity in the axial direction of the coil, than in the radial direction. The ratio between axial and radial conductivities, depending upon the temperature range, can be as high as 20 to 1. It is also known that as the radius of a coil increases, the effective radial conductivity decreases. Axial conductivity, on the other hand, does not change with an increase in coil radius, so long as the width of the coiled silicon steel strip remains unchanged.

Ideally, heating coils from only the axial direction would be most desirable. This could be accomplished in an efficient manner with heating elements mounted on the sides of the bell if the coils to be heated were placed within the furnace with their axes horizontal. Experience has shown, however, that such an approach is unsuccessful because the coils tend to collapse under their own weight. Thus, it has been common practice to orient the one or more coils within the furnace with the eye of each coil extending vertically (i.e. with the axis of each coil vertically oriented). Prior art furnaces generally have heating elements in the base and on the roof (as well as on the side and end walls) of the bell to take advantage of heating from the axial directions.

The provision of heating elements in the base of a box annealing furnace has yielded problems which have plagued the industry for many years. When heating elements are located in the base of the furnace, it is necessary to provide a heavy steel base plate for the support of each coil together with attendant support structure for each base plate. By virtue of the heat and the weight imposed upon them, it is not uncommon for the base plates to distort or sag. This, in turn, results in localized stress within the coils mounted thereon causing distortion and yield loss. For this reason, the base plates are a constant source of maintenance problems. In addition, the base plates constitute a considerable mass to be heated and cooled, thus tending to lengthen the heating and cooling portions of the furnace cycle.

In the treatment of coils of the type contemplated by the present invention, a coil temperature of at least about 2150° F. should be maintained during the soak portion of the furnace cycle. It is also important to establish a uniform temperature profile from the outer to the inner radius of a coil to minimize thermal stresses which can contribute to poor strip shape. Large temperature gradients cause the hotter portions of the coil to loosen up. This loosening of the coil convolutions exposes the entire width of the coil laps to the reducing hydrogen atmosphere, allowing the fayalite layer (formed during decarburization) to be reduced by the hydrogen. Reduction of the fayalite layer does not allow formation of a mill glass, which can be desired on grain oriented silicon steel.

The present invention is based on the discovery that in a metallic coil annealing furnace, if a ceramic base is provided (eliminating metallic coil-supporting base plates); if the bell side and end walls and roof are covered on their inside surfaces with ceramic fiber; and if the heating elements are properly located on the bell side and end walls and roof with elimination of base heating elements, this combination of elements will provide optimum product quality (both magnetic and physical), furnace productivity, low maintenance and energy savings. The use of fiber insulation in the bell yields a considerable improvement over conventional fire brick in energy consumption, furnace productivity and maintenance requirements. The use of fiber insulation reduces both the heat-up and cool-down portions of the furnace cycle. The use of a cast refractory base and the elimination of large metallic coil-supporting plates provide a number of advantages. First of all, it eliminates the costly maintenance required by the heavy steel base plates and the necessity of heating and cooling these massive plates during the furnace cycle. Secondly, the use of a cast refractory base provides a solid support structure for the entire bottom area of the coils. This distributes the coil weight uniformly and provides improved strip shape after the anneal. Thirdly, the refractory base minimizes the heat loss from the bottom of the coils. It has further been found that the combination of roof, side wall and end wall heating elements provides the maximum amount of heat to the coils without problems associated with heating elements located in the furnace base. The majority of the heating is provided by the roof elements because of the above noted heating characteristics of the coils.

DISCLOSURE OF THE INVENTION

According to the invention there is provided a high temperature box annealing furnace for metallic coil annealing practices. The furnace comprises a fixed base and a movable bell. The bell is capable of achieving a sealed relationship with the base, preferably utilizing both sand and water seals.

The interior of the bell side walls, end walls and roof are lined with ceramic fiber insulation and are provided with heating elements divided into at least two separately controllable zones. The first zone includes those heating elements mounted on the bell roof and the upper portion of the bell side and end walls. The second zone includes the remaining heating elements mounted on the lower portion of the bell side and end walls. While any appropriate electrical heating elements may be utilized such as rod elements, ribbon elements and the like (all well known in the art), rod elements are preferred by virtue of their longer service life.

The base of the furnace comprises a steel framework supporting a cast refractory base member. The cast refractory base member supports one or more coils. Means are provided in association with each coil position to introduce an appropriate annealing atmosphere into the eye of the coil. Any appropriate annealing atmosphere may be used such as pure hydrogen, a combination of hydrogen and nitrogen, argon or the like. Each coil is preferably provided with a coil cover. The coil covers maintain the annealing atmosphere in close proximity to the coils to assist in removing water from an annealing separator coating such as magnesia, or the like, on the coil convolutions. The coil covers also serve as an intermediary between the coils and the furnace heating elements, providing for a more uniform heating of the coils. A sand seal is provided for the bottom edge of each coil cover.

Finally, cooling capacity for the furnace is provided by the introduction of a cooling gas. This system can be a recirculatory system incorporating a blower and appropriate, conventional heat exchange apparatus.

BRIEF DESCRIPTION OF THE DRAWINGS

FIG. 2 is a cross sectional view taken along section line 2—2 of FIG. 1.

DETAILED DESCRIPTION OF THE INVENTION

Figure 1:
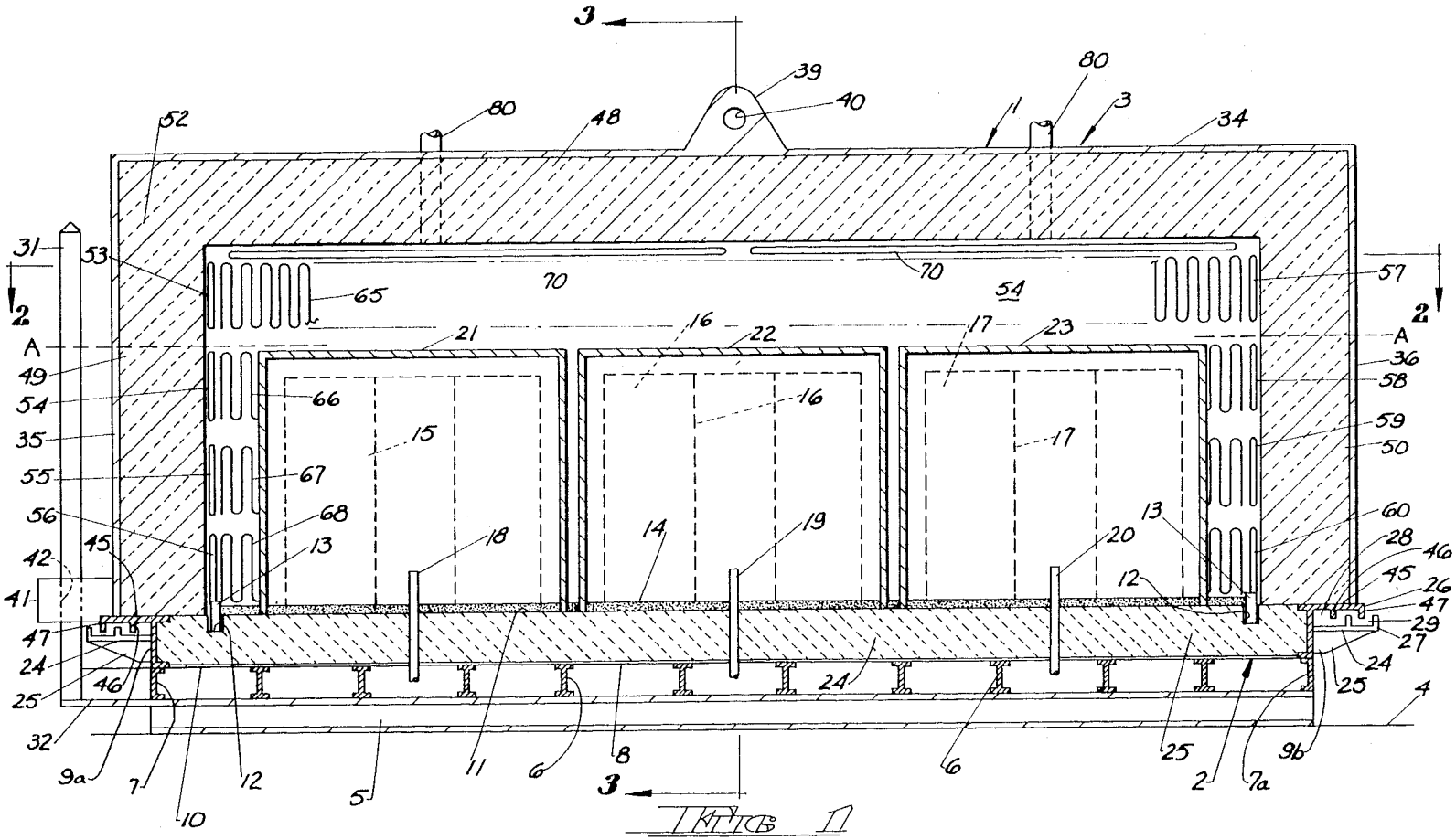
FIG. 1 is a cross sectional, side elevational view of the furnace of the present invention.
Figure 3:
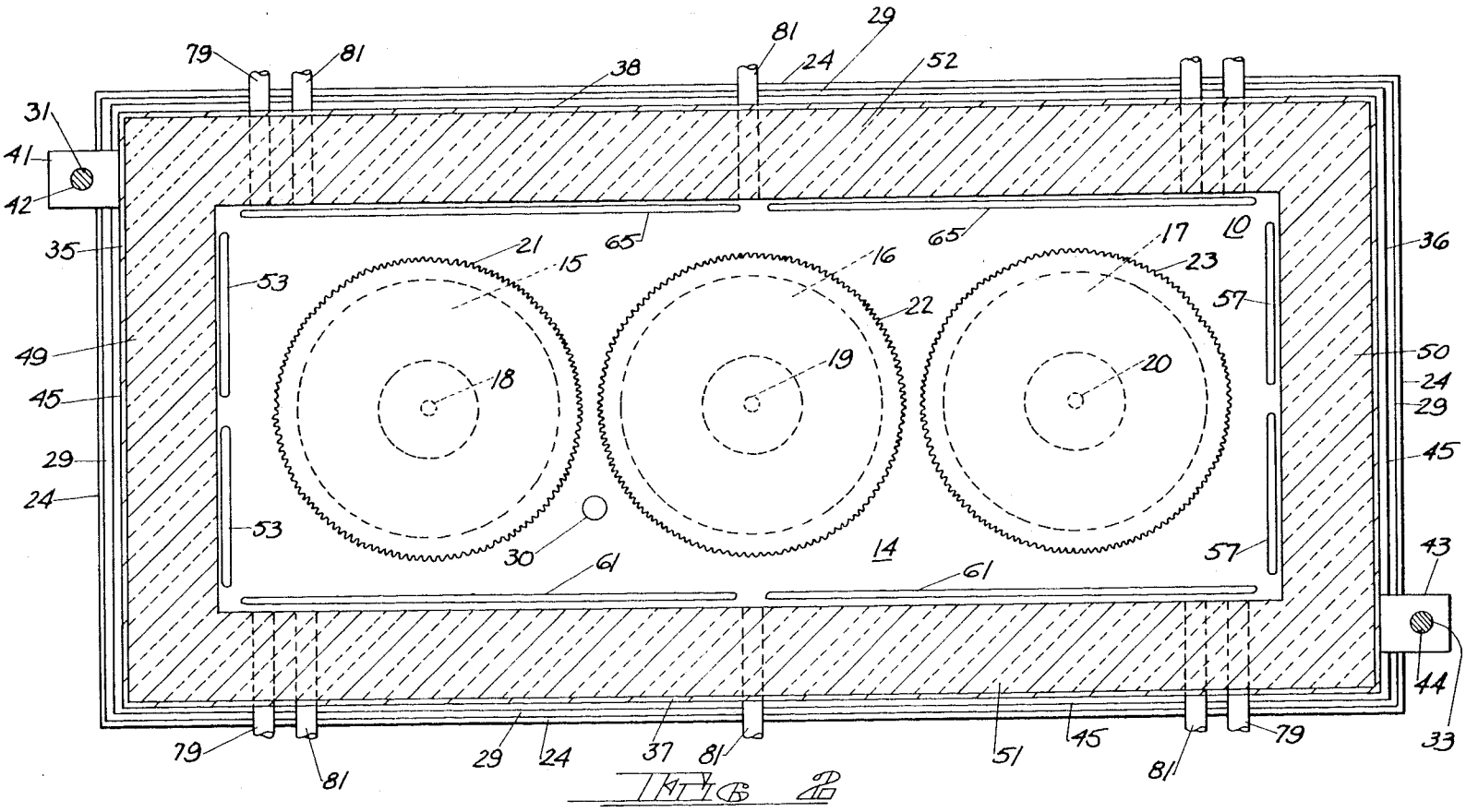
FIG. 3 is a cross sectional view taken along section line 3—3 of FIG. 1.
Figure 3:
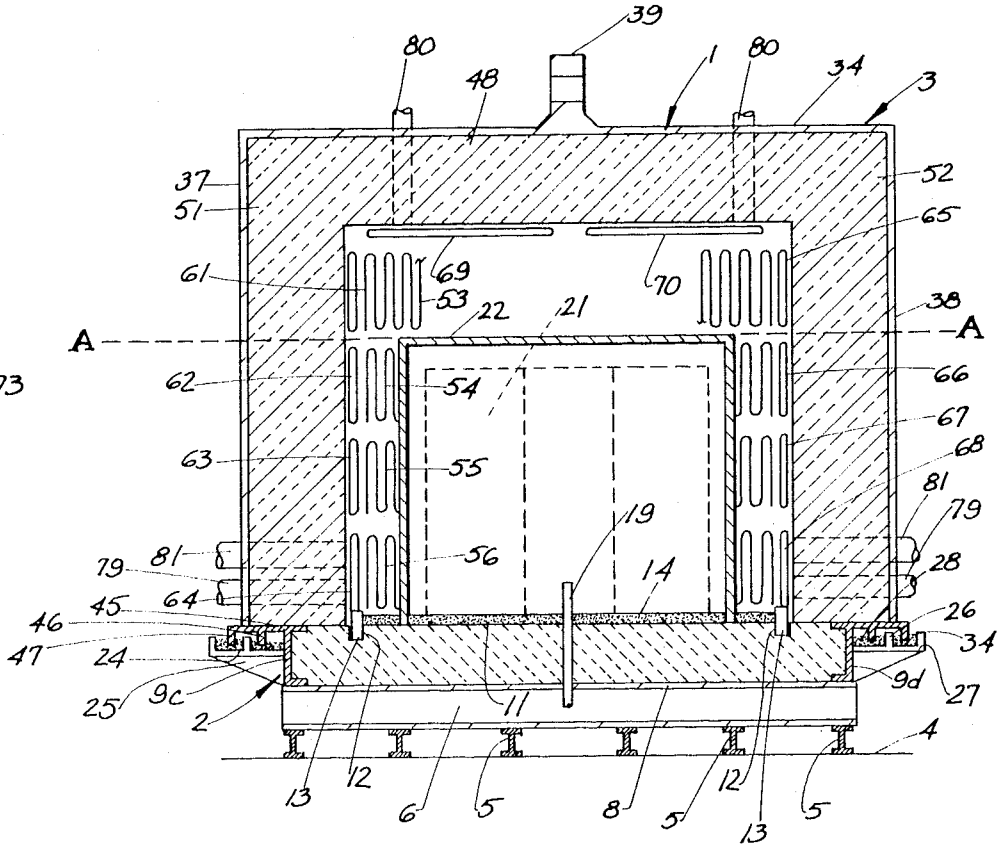

The high temperature box annealing furnace to be described is illustrated in FIGS. 1 through 3 wherein like parts have been given like index numerals. The exemplary furnace shown is capable of annealing three single-stack double coils of silicon steel ranging in weight from about 20,000 to about 28,000 pounds, with an average weight of about 22,000 pounds. The coil width (i.e. the width of the silicon steel strip forming the coil) ranges from about 35.25 to about 41 inches. It will be understood that the number of coils and their width and weight do not constitute a limitation on the present invention.

The furnace of the present invention has a cycle time of about 80 hours (when annealing regular grain oriented silicon steel), made up of the following stages: purge about 4 hours, heat-up about 30 hours, soak about 24 hours at at least 2150° F., and cool-down about 22 hours. For a final anneal of regular grain oriented silicon steel, this represents a time savings of from about 12 to about 14 hours as compared to the use of the usual high temperature box annealing furnace. With other products, similar time savings are gained.

Turning to the Figures, the furnace is generally indicated at 1 and comprises a base generally indicated at 2 and a bell generally indicated at 3. An appropriate floor or supporting surface for the furnace is shown in FIGS. 1 and 3 at 4.

While the basic framework of base 2 can take any appropriate form, for purposes of an exemplary showing it is illustrated as comprising a plurality of I-beams 5 mounted on surface 4 and extending longitudinally of the furnace in parallel spaced relationship. The I-beams 5 are surmounted by a plurality of I-beams 6 in parallel spaced relationship and extending transversely of I-beams 5 and the furnace. At their ends, the I-beams 5 are surmounted by channel beams 7 and **7*a* (see FIG. 1**).

The beams 5, 6, 7 and **7*a* support a metallic base or platform 8 surrounded on all four sides by large channel beams 9*a* through 9*d*. The base 8 and beams 9*a* through 9*d* form a steel shell containing a cast refractory base 10. The cast refractory base 10 is illustrated as being a single layer, cast, one-piece structure. The base 10 could also be a multiple layer structure. For example, the base 10 could comprise a lower, less dense, cast refractory material or refractory brick material for better insulative characteristics, surmounted by a more dense, cast refractory layer for better coil support. It would also be within the scope of the invention to make up base 10** of cast refractory blocks of one or more cast refractory materials.

Cast refractory base 10 has an upper surface 11 intended to support three coils in the embodiment illustrated. Inset from its peripheral edges, the surface 11 has a continuous notch or groove 12 adapted to receive a plurality of refractory bricks 13. The bricks 13 form a low upstanding wall or flange about surface 11 permitting the location of a layer 14 of sand on the surface 11. The layer 14 of sand may have any appropriate thickness. In a preferred embodiment, the sand layer 14 will be from about 2 to about 4 inches thick. The sand layer 14 could be isolated from surface 11 by a thin layer (not shown) of sheet metal or other appropriate material capable of withstanding the furnace temperature. In this way, the surface 11 could be protected from any harmful or abrasive action of the sand, particularly under the weight of the coils. The surface 11 and sand layer 14 support coils 15, 16 and 17, shown in broken lines.

At each coil position, there is an annealing atmosphere inlet conduit which extends through the cast refractory base 10 and supporting plate 8. The annealing atmosphere inlet conduits are shown at 18, 19 and 20. It will be understood that the annealing atmosphere inlets 18, 19 and 20 will be connected to an appropriate manifold (not shown) leading to a source of annealing atmosphere such as pure hydrogen or a hydrogen-nitrogen combination. It will be evident from the Figures that the annealing atmosphere inlets 18, 19 and 20 introduce the annealing atmosphere into the eye or center of their respective coils 15, 16 and 17.

The cast refractory base 10 and its sand layer 14 eliminate the need for the conventional heavy steel base plates normally used to support coils in a furnace of this type. Such heavy steel base plates constitute a considerable mass to be heated and cooled during a cycle and tend to distort or sag under the weight of the coils, particularly when heating elements are located in the base of the furnace. It will be noted that no heating elements are located in association with base 2 of the present invention. Thus, the cast refractory base 10 and its upper surface 11 with sand layer 14 provide solid support for the entire bottom areas of the coils 15, 16 and 17, distributing the coil weight uniformly and preventing stress build-up within portions of the coils. As a result, after the anneal the coiled silicon steel strip will demonstrate a better strip shape. Furthermore, the cast refractory base 10 and sand layer 14 minimize heat loss from the bottom of the coils they support.

Each of the coils 15, 16 and 17 is provided with a cylindrical coil cover, the upper end of which is closed and the lower end of which is open. Such coil covers are shown at 21, 22 and 23 and are preferably made of corrugated metal or the like. The sand layer 14 is adapted to receive the open ends of coil covers 21 through 23, respectively, forming a gas permeable seal therewith.

While the use of coil covers 21 through 23 is not mandatory, it is preferred because the coil covers tend to maintain the annealing atmosphere in close proximity to the coils, aiding in the removal of water from the annealing separator with which the coiled silicon steel strips are coated. Any appropriate annealing separator can be used, of which magnesia is a well known example. Furthermore, the coil covers 21 through 23 serve as intermediaries between the coils and the furnace heating elements (to be described hereinafter) tending to provide for more uniform heating of the coils.

The base 2 is provided with a metallic flange 24 which extends about its periphery and which is supported by a plurality of substantially triangular braces 25. The flange 24 carries a pair of upstanding members 26 and 27 which extend about the periphery of the furnance base and which form a pair of troughs 28 and 29, which also extend continuously about the base 2. The inner trough 28 is filled with sand and the outer trough 29 is filled with water to serve as seal means for the bell 3, as will be described hereinafter.

The base 2 is provided with one or more additional inlets for nitrogen or an inert gas so that in case of emergency (such as a leak of ambient atmosphere into the furnace), the furnace can be quickly and efficiently purged. One such inlet is shown at 30 in FIG. 2.

To complete the base 2, a vertical bell guide 31 is mounted near the corner of the base by appropriate support means 32. The bell guide 31 extends vertically above the base to a point above the level of the tops of coil covers 21 through 23. The opposite corner of the base 2 is provided with a substantially identical bell guide, as is shown at 33 in FIG. 2. The purpose of bell guides 31 and 33 will be apparent hereinafter.

The bell 3 comprises a rectangular metallic cover or chamber having a roof 34, end walls 35 and 36, and side walls 37 and 38. The bell 3 may be provided with one or more lift rings by which it may be removed from base 2 by a crane or the like. In the embodiment illustrated, a single lift ring 39 is shown, mounted centrally of roof 34 and having a perforation 40 therethrough for engagement by a crane hook or the like.

A fabricated metallic guide member 41 is affixed to end wall 35. The guide member has a perforation 42 therethrough, adapted to cooperate with vertical bell guide 31 mounted on base 2. Similarly, end wall 36 is provided with a fabricated guide member 43 (see FIG. 2). The guide member 43 has a perforation 44 adapted to cooperate with vertical bell guide 33 mounted on base 2. Thus, when bell 3 is lifted from base 2, the guide members 41 and 43 will cooperate with vertical bell guides 31 and 33 to assure that the bell properly clears the coils 15, 16 and 17 and their respective cover 21 through 23. In similar fashion, when bell 3 is to be mounted on base 2, the vertical bell guides 31 and 33 are threaded through guide member perforations 42 and 44. This will assure that the bell will shift downwardly without lateral movement and ultimately seat properly on base 2.

The bottom edges of bell end walls 35 and 36 and side walls 37 and 38 terminate in horizontal, coplanar metallic plates forming a horizontal flange 45 extending about the lower edge of bell 3. The flange 45 has a pair of downwardly depending members 46 and 47 in parallel spaced relationship and so positioned about the bell as to extend into and centrally of troughs 28 and 29 to assure both a sand and water seal about and between the base 2 and bell 3 when the bell 3 is fully seated thereon.

The inside surfaces of the bell roof 34, end walls 35 and 36 and side walls 37 and 38 are lined with ceramic fiber blocks of the type set forth in U.S. Pat. No. 3,819,468, the teachings of which are incorporated herein by reference. Briefly, blocks of ceramic fibers are made up with the fibers so arranged as to be substantially perpendicular to the inside surface of the bell 3 that they cover. Layers of the ceramic fiber are cut from blankets thereof and laminated one upon the other to form a square approximately 12 inches on a side. Blocks of the type taught in the above mentioned U.S. Pat. No. 3,819,468 may be affixed to an expanded metal backing (not shown). This backing, in turn, is stud welded to the inside surfaces of the bell top 34, end walls 35 and 36, and side walls 37 and 38. —

The use of fiber insulation to replace the more conventional brick lining has been found to increase the energy efficiency of the box anneal furnace 1, as well as its productivity. The ceramic fiber insulation has low heat retention characteristics, as compared to a brick lining, thus decreasing the heat-up and cool-down portions of the furnace cycle. Since the ceramic fiber insulation is affixed to the inside surfaces of roof 34, end walls 35 and 36 and side walls 37 and 38 as individual blocks, they can be more easily maintained and replaced than a conventional brick lining, wherein the bricks are tied together and must be replaced at least one wall at a time. In a furnace utilizing the cycle described above, the use of 12 inch thick ceramic fiber insulation has been determined to save from about 4,000,000 to about 5,000,000 BTU's per cycle. This, in turn, translates into a significant KWH cost savings. The ceramic fiber insulation on bell roof 34, end walls 35 and 36 and side walls 37 and 38 is shown respectively at 48 through 52.

While in some installations it will be sufficient to provide heating elements mounted on the roof 34 of bell 3, it is sometimes necessary to provide heating elements on end walls 35 and 36 and side walls 37 and 38, as well, to provide sufficient heat to achieve temperature and productivity requirements. Any appropriate electrical resistance heating elements can be used including ribbon elements, rod elements and the like. To this end, end wall 35 is shown having four horizontal rows or banks of heating elements 53, 54, 55 and 56. Similarly, end wall 36 has four horizontal banks of heating elements 57, 58, 59 and 60 (see FIG. 1). Side walls 37 and 38 are provided with similar horizontal banks of heating elements 61, 62, 63, 64 and 65, 66, 67, 68, respectively (see FIG. 3). The roof 34 supports at least two banks of heating elements 69 and 70. The heating elements are divided into upper and lower zones, indicated in FIGS. 1 and 3 by the horizontal broken line A—A. The heating elements in the lower zone are separately controllable from those in the upper zone. The heating elements in the lower zone include the lower three banks of heating elements on end walls 35 and 36 and side walls 37 and 38. The upper zone includes the upper bank of heating elements on the end and side walls together with the heating elements on roof 34. Since central coil 16 lies opposite heating elements only on side walls 37 and 38, while coil 15 lies opposite heating elements on the side walls and end wall 35 and coil 17 lies opposite heating coils on the side walls and end wall 36, it is within the scope of the invention to divide the elements on side walls 37 and 38 into additional vertical zones, separately controlled, to assure adequate heating of coil 16.

Figure 4:
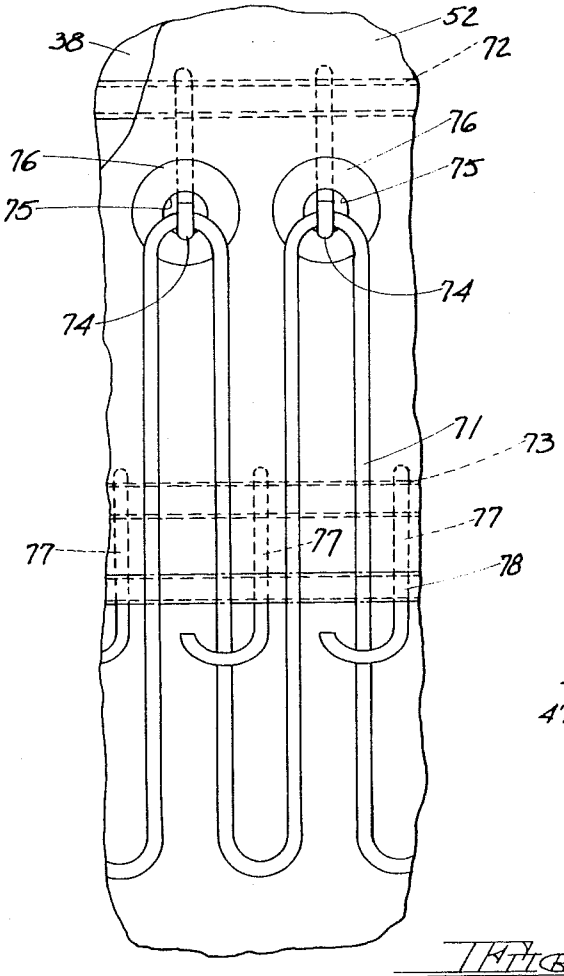
FIG. 4 is a fragmentary elevational view of an exemplary heating element.

Any appropriate electrical resistance heating elements can be used in the furnace of the present invention including ribbon elements, rod elements and the like. A preferred type of heating element is taught in U.S. Pat. No. 4,154,975, the teachings of which are incorporated herein by reference. Reference is now made to FIG. 4 illustrating a fragmentary portion of the upper bank 65 of heating elements mounted on side wall 38. It will be understood that all of the other heating elements in bell 3 will be substantially identical to those shown in FIG. 4.

In FIG. 4 a sinuous rod-like heating element (as taught in the above mentioned U.S. Pat. No. 4,154,975) is shown at 71. It will be noted that the heating element convolutions are substantially vertical. To support the rod-like heating element 71 along the face of insulative layer 52, upper and lower anchor members 72 and 73 are located within the interior of the ceramic fiber insulative layer 52 in parallel spaced relationship. The anchor members 72 and 73 are also in parallel spaced relationship with respect to wall 38 of bell 3. The anchor members 72 and 73 are preferably ceramic tubes. A plurality of S-shaped support members 74 are provided having oppositely directed hook-shaped configurations at their ends. One end of each of the support members 74 engages the anchor member 72. The other end of each support member 74 extends through a central perforation 75 in a disk-shaped ceramic spacer 76 (located on the hot face of the fiber insulation 52) and engages the rod-like heating element 71. A second set of support members 77 is provided. Each support member 77 terminates at its ends in hook-like configurations oriented at 90° with respect to each other. One end of each support member 77 engages the lower anchor member 73, while the other end of each support member 77 extends through the hot face of the ceramic fiber insulation 52 and engages a convolution of heating rod 71. To complete the structure an elongated ceramic spacer 78 is located between the hot face of ceramic fiber insulation 52 and rod-like heating element 71, being supported by support members 77. The spacer 78 comprises a ceramic tube similar to anchor members 72 and 73.

In the practice of the present invention is has been found preferable to make supports 74 and 77 of ceramic material, rather than of metal. Any inert ceramic material having appropriate strength and temperature characteristics can be used. Ceramic supports have been found to be free of creep failure sometimes demonstrated by metallic supports. It is also preferred that the rod-like heating element 71 be made of molybdenum. Excellent results have also been achieved with heating elements made of 70% nickel-30% chromium rod and 80% nickel-20% chromium rod. While not required, it has been found preferable to supply power to the heating elements by a 480 volt system. Such a system provides a considerable savings with respect to the electrical supply and control components over the conventional 240 volt systems.

The furnace 1 will be provided with one or more outlets 79 in bell 3 for the annealing atmosphere. The outlets 79 may be connected to any appropriate means such as a burn-off (not shown), or the like. The furnace 1 is also provided with inlets 80 and outlets 81 for a cooling atmosphere such as hydrogen, used during the cool-down portion of the furnace cycle. The inlets 80 and outlets 81 may, if desired, constitute a part of a recirculatory system, in which case they will be appropriately connected to one or more heat exchanger means and a blower (not shown).

It will be understood that the furnace of the present invention will be provided with a full compliment of controls, sensors and the like. These elements are well known in the art and do not constitute a part of the present invention. The furnace cycle (including heating and cooling rates, atmosphere control, and the like) can be manually or computer controlled, or both. Various types of computer and manual controls are well known in the art and again they do not constitute a part of the present invention.

As indicated above, the furnace of the present invention can be applied to all coil annealing practices. U.S. Pat. Nos. 3,939,296 and 3,971,679 teach exemplary, but non-limiting, cycles of the type which could be practiced in the high temperature box annealing furnace of the present invention with the achievement of an optimum combination of product quality, furnace productivity and energy savings.

Modifications may be made in the invention without departing from the spirit of it.

What is claimed is:

1. In a high temperature box annealing furnace for metallic coil annealing practices, and of the type having a fixed base and a removable bell having side walls, end walls and a roof and being capable of achieving a sealed relationship with said base, the improvement comprising a lining of ceramic fiber insulation on the inside surfaces of said bell side walls, end walls and roof, a plurality of heating elements mounted on said bell roof adjacent the inside surface of said ceramic fiber insulation lining thereon, a plurality of heating elements mounted on said bell side and end walls adjacent the inside surface of said ceramic fiber insulation lining thereon, said heating elements being divided into separately controllable zones, said furnace base comprising a metallic framework supporting a cast refractory base member having a substantially planar horizontal upper surface to directly support at least one coil.

2. The furnace claimed in claim 1 wherein said cast refractory base comprises a single, cast, one-piece structure.

3. The furnace claimed in claim 1 wherein said cast refractory base comprises two layers one above the other, the lower one of said layers comprising a structure of refractory material of high insulative character chosen from the class consisting of a unitary, one-piece cast structure and refractory bricks and said upper one of said layers comprising a unitary, one-piece structure of more dense cast refractory material for better coil support.

4. The furnace claimed in claim 1 wherein said refractory base is made up of a plurality of blocks of cast refractory material.

5. The furnace claimed in claim 1 wherein said cast refractory base comprises two layers one above the other, said lower one of said layers comprising a plurality of blocks of less dense cast refractory material of high insulative character and said upper one of said layers comprising a plurality of blocks of more dense cast refractory material for better coil support.

6. The furnace claimed in claim 1 including a layer of sand on said upper surface of said cast refractory base member.

7. The furnace claimed in claim 1 including an annealing atmosphere inlet extending through said base for each metallic coil supported thereon, each inlet being so located in said base as to extend into the center of its respective coil.

8. The furnace claimed in claim 1 including at least one inlet for a non-reactive purge gas whereby said furnace can be quickly and efficiently purged in case of emergency.

9. The furnace claimed in claim 1 wherein said insulative lining on said bell side walls, end walls and roof comprises a plurality of individual blocks of said ceramic fiber insulation.

10. The furnace claimed in claim 1 wherein said heating elements comprise sinuous rod-like electrical resistance heating elements arranged in banks thereof.

11. The furnace claimed in claim 1 including a coil cover for said at least one coil, said coil cover comprising a cylindrical element having a closed upper end and an open lower end configured to make a gas pervious seal with said sand layer.

12. In a high temperature box annealing furnace for metallic coil annealing practices, and of the type having a fixed base and a removable bell having side walls, end walls and a roof and being capable of achieving a sealed relationship with said base, the improvement comprising a lining of ceramic fiber insulation on the inside surfaces of said bell side walls, end walls and roof, a plurality of heating elements mounted on said bell roof adjacent inside surface of said ceramic fiber insulation lining thereon, said roof mounted heating elements comprising sinuous rod-like electrical resistance heating elements arranged in banks, a plurality of sinuous rod-like electrical resistance heating elements mounted on said bell side and end walls adjacent the inside surface of said ceramic fiber insulation lining thereon, said heating elements on said bell side and end walls being arranged in horizontal banks, said heating elements being divided into at least two separately controlled zones, the first of said at least two zones comprising said banks of heating elements on said bell roof and the uppermost horizontal banks of heating elements on said bell side and end walls, said second of said at least two zones comprising the remaining horizontal heating element banks on said bell side and end walls, said furnace base comprising a metallic framework supporting a cast refractory base member having a substantially planar horizontal upper surface to directly support at least one coil.

13. The furnace claimed in claim 12 including a layer of sand on said upper surface of said cast refractory base member.

14. The furnace claimed in claim 13 including a coil cover for said at least one coil, said coil cover comprising a cylindrical element having a closed upper end and an open lower end configured to make a gas pervious seal with said sand layer.

15. The furnace claimed in claim 14 wherein said cast refractory base comprises a single, cast, one-piece structure.

16. The furnace claimed in claim 14 wherein said cast refractory base comprises two layers one above the other, the lower one of said layers comprising a structure of refractory material of high insulative character chosen from the class consisting of a unitary, one-piece cast structure and refractory bricks and said upper one of said layers comprising a unitary, one-piece structure of more dense cast refractory material for better coil support.

17. The furnace claimed in claim 14 wherein said refractory base is made up of a plurality of blocks of cast refractory material.

18. The furnace claimed in claim 14 wherein said cast refractory base comprises two layers one above the other, said lower one of said layers comprising a plurality of blocks of less dense cast refractory material of high insulative character and said upper one of said layers comprising a plurality of blocks of more dense cast refractory material for better coil support.

19. The furnace claimed in claim 1 or 12 including a 480 volt electrical system to supply power to said heating elements.

* * * * *